US010159323B1

(12) United States Patent
Dinkins

(10) Patent No.: US 10,159,323 B1
(45) Date of Patent: Dec. 25, 2018

(54) TWO WAY SPRAY SYSTEM

(71) Applicant: Jannell Mishawne Dinkins, Baltimore, MD (US)

(72) Inventor: Jannell Mishawne Dinkins, Baltimore, MD (US)

( * ) Notice: Subject to any disclaimer, the term of this patent is extended or adjusted under 35 U.S.C. 154(b) by 0 days.

(21) Appl. No.: 15/530,381

(22) Filed: Jan. 6, 2017

(51) Int. Cl.

| | |
|---|---|
| ***A45D 19/02*** | (2006.01) |
| ***E03C 1/04*** | (2006.01) |
| ***B05B 1/18*** | (2006.01) |
| ***B05B 13/02*** | (2006.01) |
| *A45D 19/00* | (2006.01) |

(52) U.S. Cl.
CPC ..... *A45D 19/02* (2013.01); *B05B 1/185* (2013.01); *B05B 13/0278* (2013.01); *E03C 1/0409* (2013.01); *A45D 2019/005* (2013.01); *A45D 2019/0058* (2013.01); *E03C 2001/0414* (2013.01)

(58) Field of Classification Search
CPC ..... A45D 19/14
USPC ..... 4/515–523
See application file for complete search history.

(56) References Cited

U.S. PATENT DOCUMENTS

| | | | | |
|---|---|---|---|---|
| 4,901,378 | A * | 2/1990 | Reddell | A45D 19/08 4/515 |
| 6,728,977 | B1 * | 5/2004 | Knight | A45D 19/14 4/515 |
| 2002/0184703 | A1 * | 12/2002 | Minami | A45D 19/10 4/515 |
| 2006/0053545 | A1 * | 3/2006 | Schulken | A45D 19/10 4/515 |

* cited by examiner

*Primary Examiner* — Lori Baker

(57) ABSTRACT

A two way spray system for shampooing and rinsing hair by saturating the entire head at once, or a section at a time with a redesigned spray handle with two control levers, and a adjustable basin spray. Inside the spray handle are three canals, a diverter canal situated between a intake canal and a outlet canal. The spray handle has a top lever that opens the intake canal sending water through the front nozzle, and a bottom lever that opens the diverter canal sending water into the outlet canal then to the basin spray in the shampoo basin. When operating both levers at once the entire head is saturated without the client having to lift or move their head. And while rinsing the back of the head the basin sprays adjustability for various length hair, children, and adults prevents water from running down their back wetting their cloths.

9 Claims, 9 Drawing Sheets

5 A
5
4
9
8
32
44 A
37
41
45
6
40
43 A
48
38 A
38
39
44
45 A
36
43
7
37
37
47
38
43
38 A
42
40
43 A
39

TWO WAY SPRAY SYSTEM

CROSS-REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

"Not Applicable"

STATEMENT REGARDING PRIOR DISCLOSURES BY THE INVENTOR OR A JOINT INVENTOR

"Not Applicable"

BACKGROUND OF THE INVENTION

In beauty salons there has always been difficulty for beauticians when shampooing and rinsing the back of clients heads, while very often the clients must raise their heads from a comfortable position after resting their neck in a neck cradle of the shampoo basin, while having their hair shampooed when the difficulty araises when the beautician trys to rinse the back of the clients head as the beautician trys to use one hand to make sure the back of the head is saturated with water while doing the rinsing, and with the other hand holding and controling the hand held spray handle to control its nozzle while shampooing and rinsing the client clients head. And very often when the client raises their head for rinsing the back as water runs down their neck and back wetting their clothing.

The present invention is two inventions providing a two way spray system that is a better way to deliver a spray rinse to the whole head at the same time or by one section at a time rinsing the head without the beautician having to struggle with the clients head trying to fully rinse the back of the clients head as the clients head and neck is in comfortable position without their head having excess water run down their neck and back wetting their clothing causing more discomfort as todays current equipment does.

(1) Field of the Invention

The present invention generally relates to the efficiency and ease in shampooing a clients hair for a beautician, while maintaining a comfortable experience for the client without them having to constantly lift their head and neck out of the neck cradle of todays current shampoo bowls or basins while having their hair shampooed, whereas the present invention eliminates any lifting or movement of the clients head and neck protecting them from excess water from running down their neck and back wetting their clothing preventing a very uncomfortable situatuion having their cloths becoming wet as they have their hair shampooed and rinsed.

(2) Description of the Related Art Including Information Disclosed Under 37CFR1.97 and 37CFR1.98

"Not Applicable"

BRIEF SUMMARY OF THE INVENTION

It is the object of the present invention to provide a superior water delivery system with a two way water system for shampooing and rinsing the head and hair for a more thorough saturation of the scalp in order to rinse the hair completly over the entire head without the client having to move their head by lifting it up in order to rinse the back of their head as the basin spray and the front spray together prevents the uncomfortable situation of having water run down the neck and back wetting the clients clothing. The present invention also makes it easefully and efficient for the beautician to perform their job.

A two way water delivery system from a main water supply out of a faucet through a intake water line into the hand held spray handle acting as a diverter with two operating levers that opens the front nozzle from the main water canal by the top lever as the bottom lever opens the outlet canal to the basin spray, as the top and bottom levers create a two way delivery system from the spray handle sending water in opposite directions at once or to one at a time as the top lever delivers water to the front nozzle for the top and sides of the head while the bottom lever delivers water to the basin spray in the shampoo bowl or basin to saturates and rinse the back of the clients head as they remain in one comfortable position resting in the neck cradle without having to lift or move their head in order to rinse the back of their head, with the unique position or location of the basin spray inside the shampoo bowl or basin, as it also has two adjustable movements of the basin sprays head for saturating and rinsing various length hair and to accompany adults and children.

BRIEF DESCRIPTION OF SEVERAL VIEWS OF THE DRAWINGS

For a more complete understanding of the invention having thus generally described the invention reference will be made to the accompanying drawings in which.

DETAILED DESCRIPTION OF THE INVENTION

The two way spray system is an invention that consist of two inventions in one for shampooing and rinsing hair that will provide efficiency for the beautician and comfort for their client. By creating a better way of delivering water to the head for saturation at once or for water-delivered to certain areas by a hand held spray handle that controls the system with a top and bottom lever that works as a diverter to deliver water in the customary method, by the top lever opening the front nozzle that sends water to the top and sides of the clients head. And to provide comfort to the client preventing them from having to lift or move their head and neck from the neck cradle, as a basin spray is located just below the back of their head built into the front wall of the shampoo basin, and water will be delivered to the back of their head when the beautician compress the bottom lever on the spray handle that will open the outlet canal in the spray handle sending water down the outlet hose to the basin spray, as the client remains in one position, because the basin spray is also adjustable for various length hair as well as to accomadate small children, teens, and adults.

The water pressure for both the front nozzle and the basin spray is constant as both the main intake canal of the spray handle and the outlet canal of the same are connected inside the spray handle and the water pressure is constant from the main intake hose to the intake canal.

Figure 1:
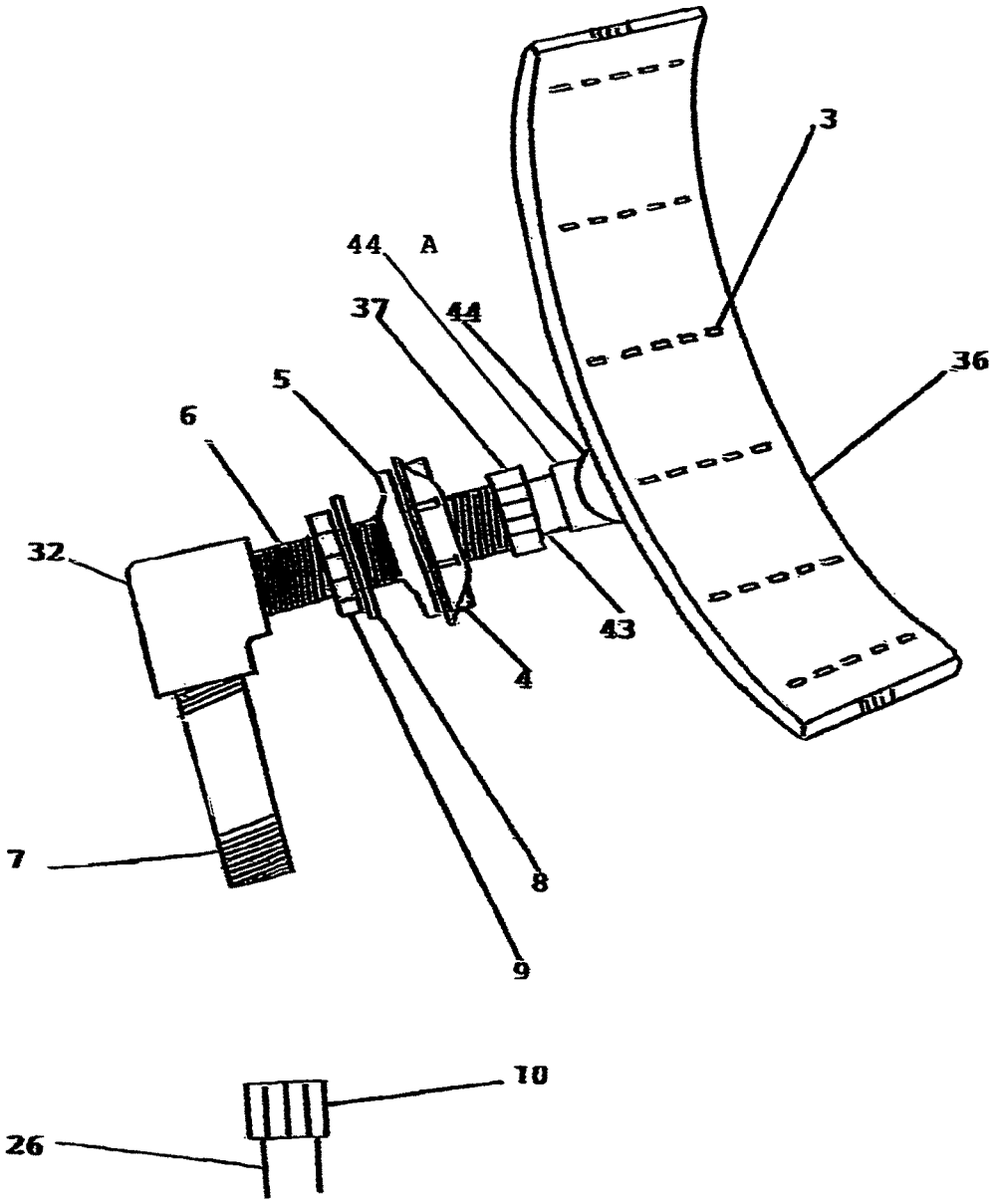
FIG. 1 is a perspective three dimentional view of the basin spray head with its water connection and connectors to the shampoo basin or bowl wall, and a blow up view of a male water hose connector.
Figure 9:
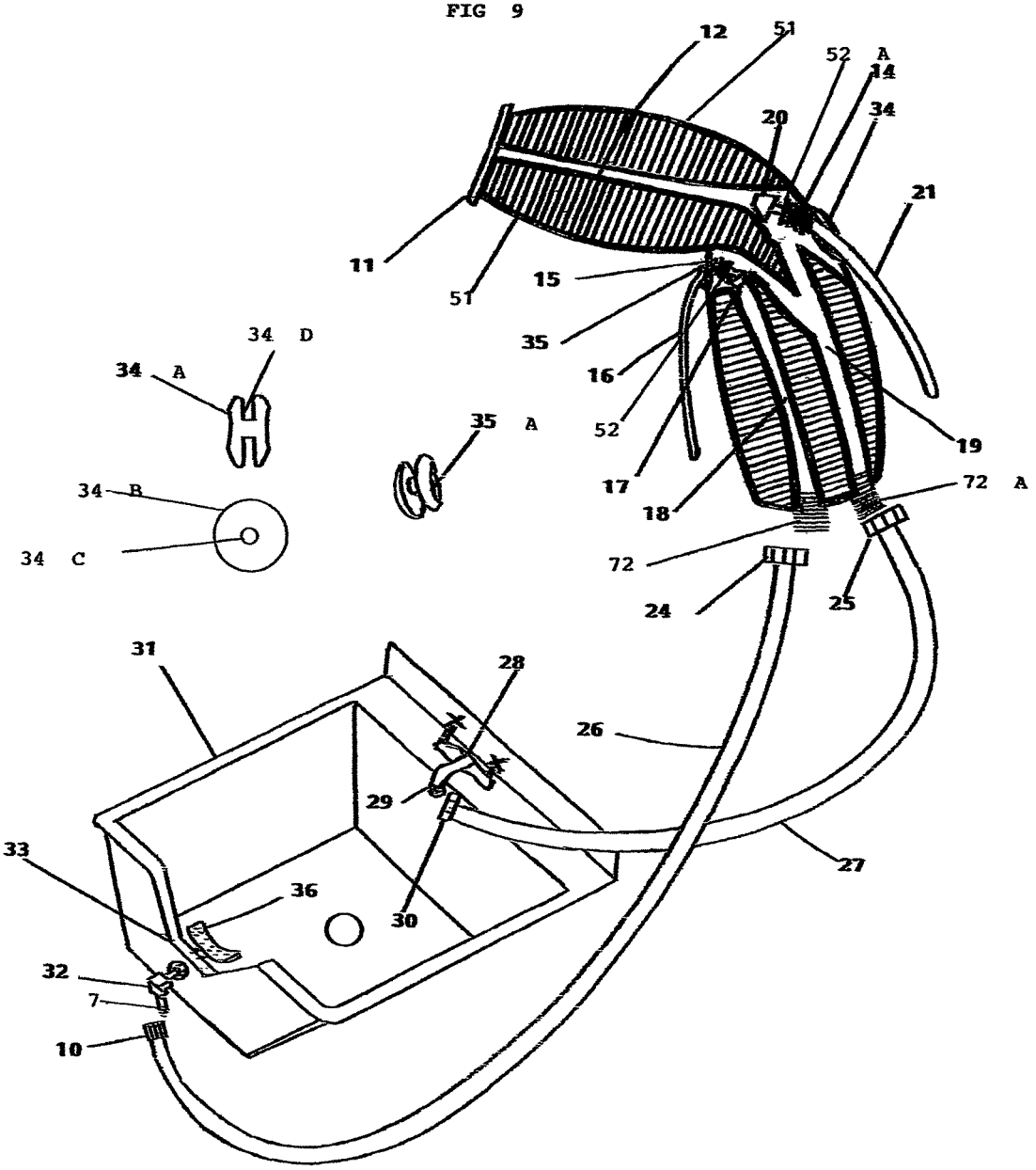
FIG. 9 is a x-ray view of the assembled spray handle in order to view its water canals, sealed gasket placements in the half round troughs, and a view of the working parts.

The two way spray system is a dual water delivery system that consist of two inventions in one that saturates the hair with water for shampooing and thoroughly rinsing the entire head at once without the client having to lift, raise, or move their head. Because the two way spray systems dual water delivery system can send water through the front spray head as performed in the standard method. But with a modification to the hand held nozzle as shown at FIG. 9 reference character 51 the water can be diverted to the second invention the basin spray as shown at FIG. 1 reference character 36 thats located inside the shampoo basin, a device thats swayable and extractable along with being adjustable, and together with the spray head they make up the two way spray system that can send water through either spray system one at a time or at the same time through both as shown at FIG. 9 reference character 21 as the top lever that sends water to the front nozzle reference character 11, then reference character 16 as the bottom lever that sends water to the basin spray reference character 36 Also at FIG. 9 water is received from the main water supply line reference character 27 from the faucet reference character 28 that sends water through the main intake water line reference character 27 as water pass through a male connector reference character 72 "A" and into a main water intake canal reference character 19 where its held until needed and released by pressing the top lever reference character 21 that opens the line stopper reference character 20 allowing water to pass through the pinched canal reference character 12 thats pinched in order to allow for a stronger water pressure as the water pass through the front spray head reference character 11. and water to the second invention called the basin spray reference character 36 the beautician squeezes the bottom lever reference character 36 that releases and diverts water by the line stopper reference character 17 allowing water to pass down through the outlet line canal reference character 18 allowing the water to flow down the outlet line reference character 26 as the water enters the double threaded nipple reference character 7 as the water then enters the double threaded elbow reference character 32. and then through the fully threaded water supply nipple reference character 6 and then through the stainless steel water supply line on FIG. 5 reference character 43 as the stainless steel water supply line as the water then pass through the collar reference character 44 "A" thats made with the water ball reference character 44 as one unit as the water goes through a coupling reference character 45 "A" also shown on FIG. 3 reference character 45 "A" as the coupling that snaps onto the water ball reference character 44 then the water goes through a exit hole reference character 48 in the water ball, then the water goes through a receiving sleeve reference character 45, as the water then goes through a water disperser opening reference character 73 that sends water through a series of spray vents that are shown on FIG. 1 reference character 3. as one of a series of water vents in the basin spray head reference character 36. after the beautician squeezes the bottom lever at FIG. 9 the hand held nozzle reference character 16 that releases the line stopper reference character 17 allowing water to pass down through the outlet canal reference character 18 as the water then flows down the outlet line reference character 26 and then through a series of water supply lines as connectors and into the basin spray that is shown on FIG. 1 reference character 36 the basin spray the second half of the two way spray system that delivers water from two directions, the basin spray and the hand held nozzle spray. This system is designed for professtional beauticians in beauty salons as well as in home hair dressers.

Figure 2:
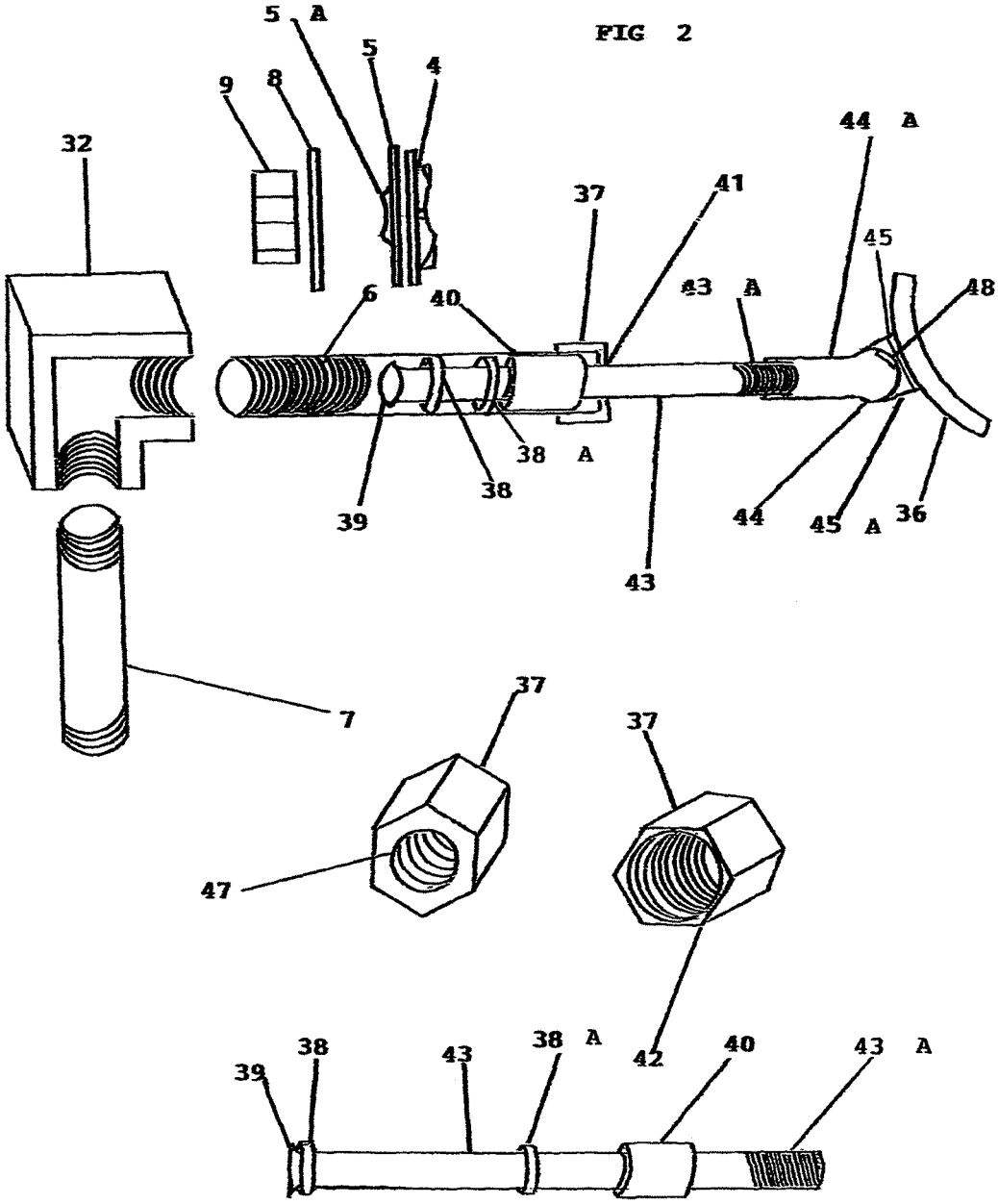
FIG. 2 represents the basin spray in a side view cut away to show the working parts assembled inside the fully threaded water supply line just before it is attached to a double threaded elbow shown just behind the assembled parts with a double threaded nipple just below the double threaded elbow before being attached as all the assembled parts make up the second drawing from the top, with the top drawing being two nuts and two washers used to attach the assembled basin spray to the front wall of the shampoo basin, as the bottom drawing represents the extractable stainless steel water supply line shown inside the side view cut away of the assembled parts where its contained inside by a retainer cap that also has the extractable stainless steel water supply pass through it for adjustability, as the retainer cap is shown in two three dimentional views showing its front and back view shown just above the bottom drawing of the extractable stainless steel water supply line with its three washers attached.
Figure 3:
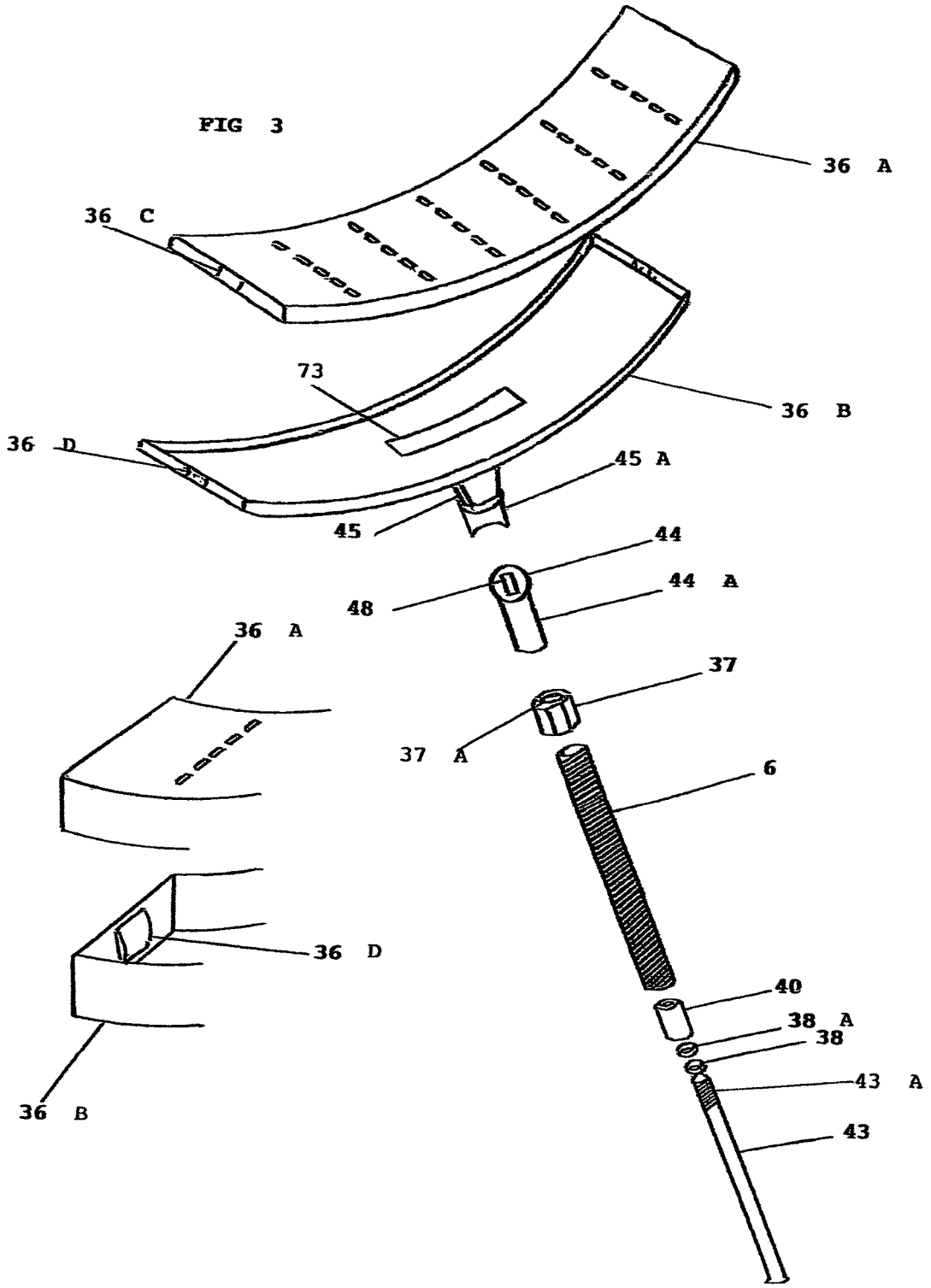
FIG. 3 is a blow up view of the parts aligned in order of assembling the the basin spray.
Figure 4:
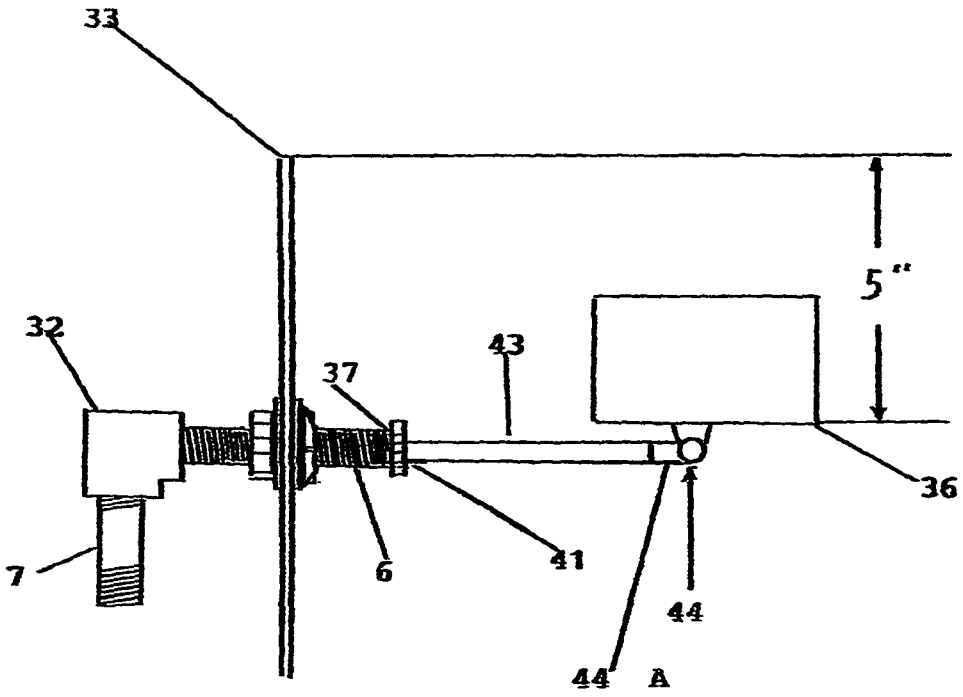
FIG. 4 is a blow up cut away side view of a shampoo basin showing the connection of the water supply lines of the basin spray while showing its extracted stainless steel water supply line with the basin in a vertical position.
Figure 5:
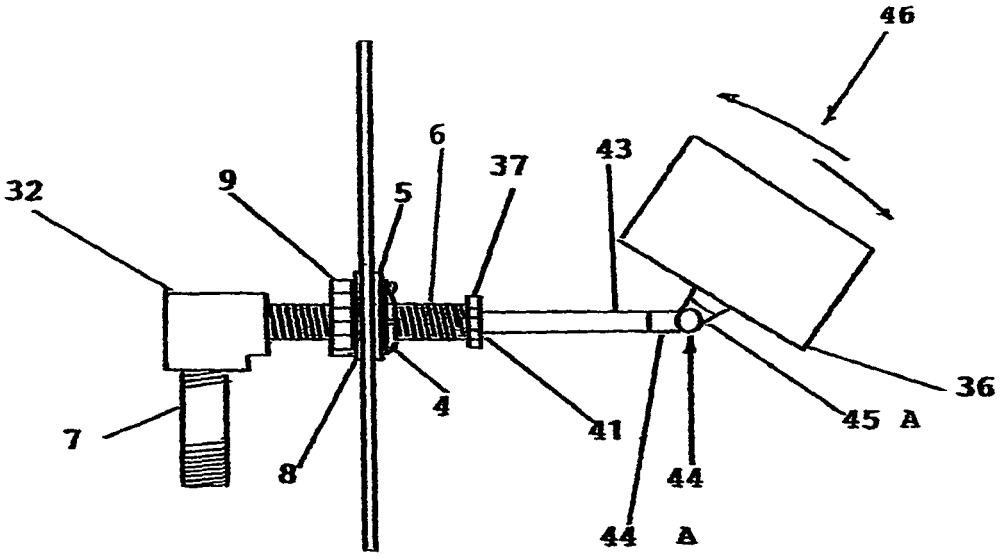
FIG. 5 is a blow up cut away side view of a shampoo basin showing the connection of the water supply lines of the basin spray while showing the contraction of the stainless steel water supply line with the basin spray into a forward tilt position displaying its adjustability.
Figure 6:
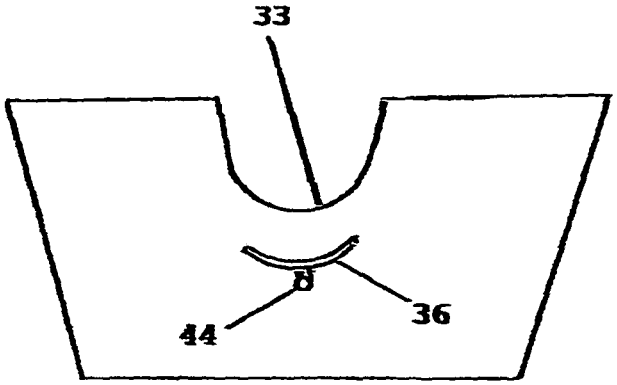
FIG. 6 is a inside view of the front wall of the shampoo basin showing the location of the basin spray after being attached.
Figure 7:
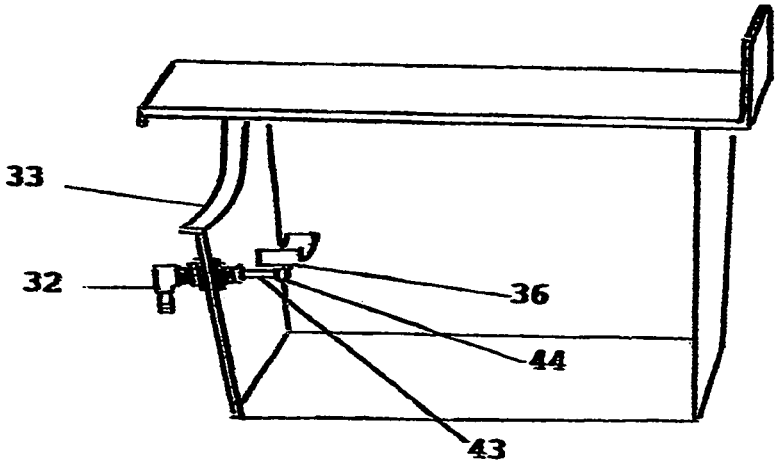
FIG. 7 is a side view of a cut away of a shampoo basin showing a show view of the connection of the basin spray to and through the shampoo basin.
Figure 8:
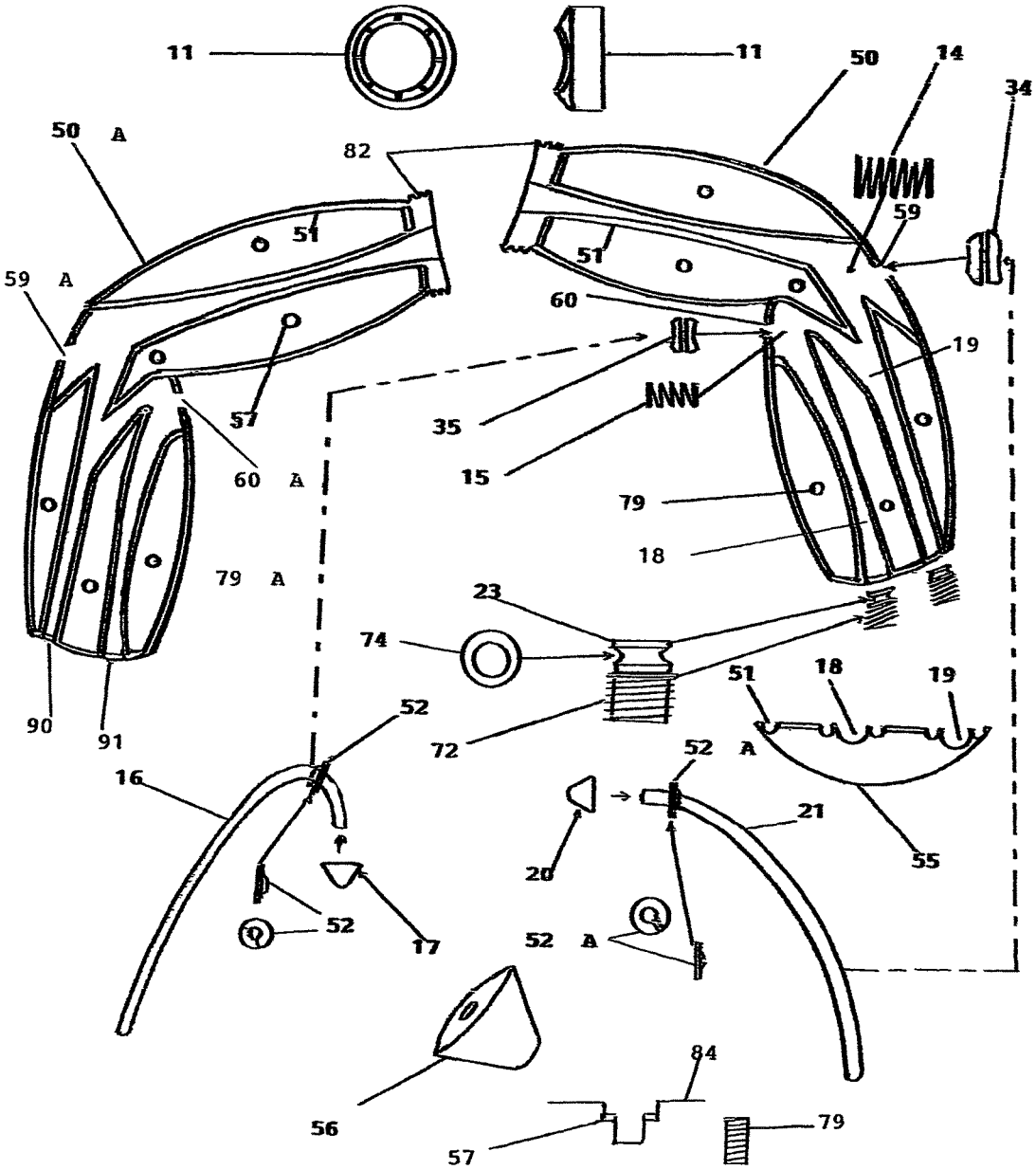
FIG. 8 is a blow up of the two half sides of the spray handle in order to show the water canals and gasket troughs along with the locations of the working parts inside the spray handle before the two halfs are put together to form the working spray handle, also the figure shows a blow up of all the working parts and a side view of a screw hole showing its counter sunk depression at its top that will recess the head of a screw below the surface of the handle, also a blow up bottom view of one half of the spray handle in proder to show the shape of the water canals and the half round gasket troughs before the two sides of the spray handle are put together.
Figure 10:
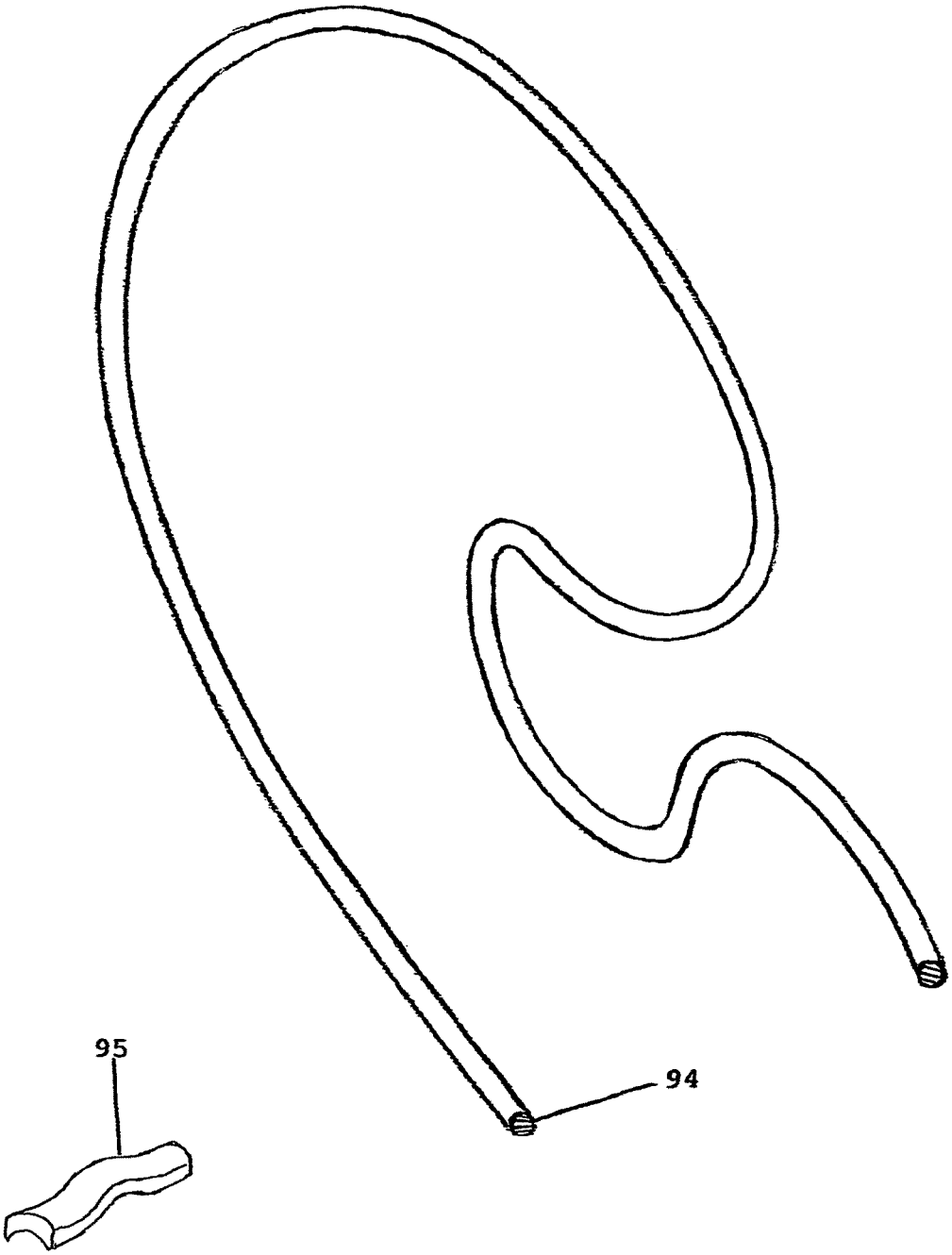
FIG. 10 is a blow up view of the round rubber gasket used to seal the outer edge of the spray hanle and the inner working parts sealing the canals, also shown is a small slice of rubber used to help seal in the half round slots of the half round troughs to seal the concave connectors along with the grummet washers where the top and bottom lever handles enter the spray handle.

The basin spray rinses the back of the clients head as well as the right and left sides at the same time or a section of the head at a time, while the advantage of using the two way spray system is that the client never has to lift or move their head allowing the uncomfortable feeling of water to run down their neck and back, while wetting their clothing as the beautician rinses the top, back, and sides. However the two way spray system can perform that task all at the same time or by each section as the client remains in one comfortable position with their neck in the neck cradle of the shampoo basin at FIG. 6 a inside view of the front wall of the shampoo basin reference character 33 as the neck cradle, and just below that is the basin spray reference character 36, and its water ball reference character 44 that performs two operatios, one is to deliver water to the basin spray, and two is to allow the basin spray head to be swayable thats shown on FIG. 5 reference character 36 as the basin spray and reference character 46 as the swayable action of the basin spray that moves by a coupling reference character 45 "A" thats connected to the water ball reference character 44 allowing for the adjustments for various hair lengths as the basin spray is also adjusted by the extractable stainless steel water supply line reference character 43, reference character 41 that shows the extractable stainless steel being extracted and guided coming through a hole in the retainer cap shown on FIG. 2 reference character 37 at the top drawing and reference character 41 where the stainless steel water supply line is being extracted, and reference character 37 at the lower drawing with two views of the retainer cap reference character 47 as the front hole where the stainless steel water supply line is extracted and guided while passing through the retainer cap, reference character 43 at the bottom drawing as the stainless steel water supply line that pass through the fully threaded nipple at the top drawing reference character 6 along with its donut shaped washer reference character 38 as the back washer, and reference character 38 "A" as the center donut shaped washer, and reference character 40 as the 1" one inch long washer thats held by the retainer cap reference character 37 shown at the middle drawing reference character 42 as the female threaded open end that is screwed onto the front of the fully threaded nipple as shown at the top drawing reference character 37, and reference character 40 as the 1" one inch long washer thats retained by the retainer cap reference character 37, and reference character 39 as the flanged end of the stainless steel supply line that prevents the stainless steel supply line from being pulled completly out of the fully threaded nipple reference character 6 the three washers, and the hole in the retainer cap. The fully threaded nipple is shown at FIG. 9 reference character 33 and secured from the inside by the doom washer shown at FIG. 2 reference character 5 and reference character 5 "A" as its doom section that fits into the hole of the shampoo basin and held there by the finger nut reference character 4 until both are secured from the outside first by the outside washer reference character 8 that secures everything to the shampoo basins wall by the outside nut reference character 9 then the double threaded elbow reference character 32 is attached to the fully threaded nipple reference character 6 then the double threaded nipple reference character 7 is attached to the bottom end of the double threaded elbow. The operation of the basin spray is shown at FIG. 4 with a measurement between reference character 36 as the basin spray and reference character 33 as the neck cradle with a distance of 5" five inchs approximatly, as the extractable stainless steel water supply line is shown in its extracted mode reference character 43 as its extracted from the fully threaded water supply nipple reference character 6, then at FIG. 5 reference character 43 the stainless steel water supply line as it is retracted back into the fully threaded water supply nipple as you view the distance compared to FIG. 4 reference character 43, while FIG. 5 shows the swayability of the basin spray reference character 46 with the two arrows depicting the back and forth action of the basin spray as it can also move side to side all by the water ball connection reference character 44 to the coupling reference character 45 "A", FIG. 5 also shows the assembly of the fully threaded water supply nipple reference character 6 and the connectors that were explained previously in this specification. The basin spray is shown at FIG. 3 is made of two sections reference character 36 "A" as the top section and reference character 36 "B" as the bottom section as each section has a locking snap clip reference character 36 "C" and reference character 36 "D" as the concave snap clip and when the top and bottom sections are put together the back of the concave snap clips snap into the bottom concave snap clips front locking the two halfs together as one unit. Each half has two concave snap clips with one on each side refere character 36 "A" as the top section and reference character 36 "B" as the bottom section that are held together by the snap clips on each half. The drawing does not show two snap clips because they are on the other side of the two halfs of the basin spray head. The snap clips are also to allow the top and bottom halfs to seperate for cleaning by prying each side open by the snap clips to open the basin spray head as all four snap clips are identical for easy opening and closing. FIG. 3 shows the assembly of the seperate working parts of the basin spray beginning with the stainless steel water supply line reference character 43 with its partially threaded front end reference character 43 "A" the stainless steel water supply line has three washers to prevent leaks placed on it reference character 38 as the front donut shaped washer, reference character 38 "A" as the middle washer, and reference character 40 as the back washer that is 1" one inch long washer The stainless steel water supply line and its three washers are placed inside the fully threaded water supply nipple reference character 6 then reference character 43 "A" as the partially threaded front end of the stainless steel water supply line that will pass through the front hole in the retainer cap reference character 37 "A" and reference character 37 as the retainer cap thats screwed onto the front end of the fully threaded water supply nipple reference character 6. The partially threaded front end of the stainless steel water supply line that passed through the front hole in the retainer cap as it is screwed into the female collar reference character reference character 44 "A" of the water ball reference character 44 as water is delivered through a slot on the water ball reference character 48 and then through the coupling reference character 45 "A" that is snapped onto the water ball giving the basin spray head its swayable action as the water pass through the receiving sleeve reference character 45. The water then goes through the water disperser opening reference character 73 thats cut into the bottom half of the basin spray reference character 36 "B" then through the top half of the basin spray reference character 36 "A" and together the two halfs are put together with four snap clips reference character 36 "C" as one of two snap clips on the top half of the basin spray head and reference character 36 "D" as one of two on the bottom half as the top and bottom halfs are snapped together to form the basin spray head reference character 36 "A" as the top half and reference character 36 "B" as the bottom half as the drawing shows how the two halfs are put together as a cut away section of the top half reference character 36 "A" and reference 36 "B" as the cut away bottom half and reference character 36 "D" as the back of the concave snap clip while viewing the complete top half reference character 36 "A" while viewing reference character 36 "C" as the concave snap clip while viewing its mating concave snap clip on the complete bottom half reference character 36 "D" on reference character 36 "B" and when the top and bottom halfs are snapped together they form the basin spray head as shown on FIG. 1 reference character 36 as the basin spray head reference character 3 as one of a series of water vents. The water is delivered to the basin spray shown on FIG. 9 reference character 36 as the beautician squeezes the bottom lever reference character 16 as the lever is depressed the line stopper reference character 17 opens sending water out the outlet canal reference character 72 then down the supply line reference character 26 then through the double threaded nipple refrence character 7 then the double threaded elbow reference character 32 and through the fully threaded water supply nipple reference character 6 that also connects the basin spray unit to the front wall of the shampoo basins neck cradle reference character 33 the water then goes through the stainless steel water supply line (not shown on this drawing) then the water enters the basin spray reference character 36 for saturation and rinsing. This whole operation starts in the shampoo basin where it ends, as the basin spray and hand held nozzle are activated. To start, the hot and cold water is mixed and tempered as it leaves the faucet reference character 28 then thru the threaded female coupling of the main water supply line that is called the inlet line reference character 27 that carrys water up to the female fitting reference character 25 thats connected to a male fitting reference character 72 "A" as the water travels into the intake canal reference character 19 and released when the beautician squeezes the top lever reference character 21 thats held in position by the grummet washer reference character 34 that also prevents leaks when the top lever is squeezed and the line stopper reference character 20 opens the pinched canal reference character 12 thats pinched to allow a stronger water pressure to the front spray head reference character 11 and when the top lever is released a stainless steel spring reference character 14 pushs against a stationary cut washer reference character 52 "A" that closes the pinch canal with the line stopper. The basin spray reference character 36 starts with the beautician sqeezinq the bottom lever reference character 16 that releases the out line stopper reference character 17 that releases water down the outlet canal reference character 18 sending water through the male connector reference character 72 that is connected by the outlet line fitting reference character 24 to allow water to flow down the outlet line reference character 26 that has a female fitting attached to the end reference character 10 that will connect the outlet line to the double threaded nipple reference character 7 as its other end of the double threaded nipple is connected to the double threaded elbow reference character 32 that has the fully threaded water supply nipple reference character 6 that pass through the wall of the shampoo basin and connected to the basin spray reference character 36 by its stainless steel water supply line (not shown on this drawing) at FIG. 9 as its connected to the female collar of the water ball that snaps into a coupling of the receiving sleeve and to the water disperser thats made onto the bottom half of the basin spray that snaps onto the top half of the basin spray. The water is stopped when the beautician releases the bottom lever reference character 16 of the hand held nozzle and the line stopper reference character 17 is pushed back into the outlet canal reference character 18 pushed by the stainless steel spring better shown on FIG. 8 reference character 15 that sits behind a stainless steel cut washer reference character 15 that sits behind a stainless steel cut washer reference character 52 in three views, with one as its attached to the bottom lever reference character 16 then a side view and front view reference character 52 that also be seen at FIG. 9 reference character 52 as the stainless steel spring pushs the stainless steel cut washer that forces the line stopper back into the outlet canal as the grummet washer seals the lever reference character 35 when the lever is activated or at rest as the grummet washer is shown in three views, a three dimentional view reference character 35 "A", a side view reference character 34 "A", and a front view reference character 34 "B". The grummet washers also play a crucial role when operating the hand held nozzle as shown thru a x-ray view of the hand held nozzle reference character 50 to show the inner workings of the hand held nozzle especially the grummet washers that seals the opening for both the top and bottom levers as shown on FIG. 9 reference character 34 "A" the side view and reference character 34 "D" the inside wall of the grummet washer, reference character 34 "B" as a front view of the grummet washer, and reference character 34 "C" as the center hole. The top lever reference character 21 and the bottom lever reference character 16 are firmly held in position by the center hole of the grummet washers that fits very tightly around the top and bottom levers when they are depressed as the inside walls of the grummet washers reference character 34 "D" that seals the two halfs of the hand held nozzle inside and outside as shown at reference character 34 as one side of the inside walls of the grummet washer 34 "A" and together each side wall will prevent water leaks, as they fit firmly in the half round slots shown on FIG. 8 reference character 59 as the half round slot in the bottom half of the hand held nozzle and reference character 60 as the half round slot on the other side of the bottom half of the hand held nozzle as both slots will hold a drummet washer each reference character 34 as the top grummet washer and reference character 35 as the bottom grummet washer as both are seated into the half round slots of the bottom half of the hand held nozzle reference character 50 as the bottom grummet washers as both are seated into their half round slots as they are met with the top slots reference character 60 "A" of the top half of the hand held nozzle reference character 50 "A" and reference character 59 "A" as the top slot that will meet the top slot in the bottom half reference character 59 as the bottom slot reference character 60 "A" meets the bottom slot in the bottom half of the hand held nozzle reference character 50 and reference character 60 as the bottom slot in the bottom half of the hand held nozzle. The top and bottom halfs of the hand held nozzle shown on FIG. 8 shows a series of open troughs that run in and around the insides of both halfs of the hand held nozzle, the bottom half reference character 50 and reference character 51 as the series of troughs and reference character 50 "A" as the top half and reference character 51 as a series of troughs that run in and around the bottom and top half. These troughs in one side or the other will have a round rubber gasket shown on FIG. 10 reference character 94 as the round rubber gasket and reference character 95 as a slice of rubber thats shaped to fit up in the half round slots of the troughs that will form a hole when closed FIG. 8 reference character 90, reference character 91 as the top half round slots and reference character 91 "A" and 90 "A" as the bottom half round slots that will form the hole for the male concave connector that will be sealed. After the round rubber gasket is placed in one or the other troughs and the grummet washers are secured in their half round slots and the slice of rubber is seated, the top half of the hand held nozzle reference character 50 "A" is placed and fitted onto the bottom half of the hand held nozzle reference character 50 the two halfs are then secured with screws shown on FIG. 8 reference character 79 thats placed in a recessed hole reference character 57 that sits below the surface of the hand held nozzle, reference character 84 as the screws that fit into a threaded hole inside the other half of the hand held nozzle, reference character 79, the hand held nozzle is shown completed and shown thru a x-ray view FIG. 9 reference character 51 as the round rubber gasket that runs in and around the troughs as the rubber gasket is shown in place between the top and bottom halfs of the hand held nozzle fitting very snug in each side of the troughs after the two halfs are screwed together. FIG. 8 is a lay out of the working parts of the hand held nozzle that also operate the basin spray showing the matching screw holes reference character 57 of the top half of the hand held nozzle and reference character 79 of the bottom half of the hand held nozzle that will match a corresponding hole in the top half of the hand held nozzle reference character 79 "A" and along with the other matching holes the top and bottom halfs are secured and seals the round rubber gasket shown on FIG. 10 as FIG. 8 shows the open two halfs of the hand held nozzle that shows how the half round troughs on each half will match up perfectly with the other to allow the round rubber gasket to form a tight seal when placed in the half round troughs and the two halfs are screwed together pressing the round rubber gasket and better sealed when the front spray head reference character 11 is screwed onto the front of the hand held nozzle aiding the screws reference character 82 as the two threaded front ends of the hand held nozzle reference characters 50 and 50 "A" reference character 51 as the half round troughs on both sides of the hand held nozzle reference character 50 as the bottom side of the hand held nozzle and reference character 50 "A" as the top half of the hand held nozzle, and reference character 59 as the half round slot in the bottom half and reference character 59 "A" as the half round slot in the top half of the hand held nozzle as both the top and bottom half round slots will have a grummet washer reference character 34 as that grummet washer, reference character 60 as the bottom half round slot in the bottom half of the hand held nozzle, and reference character 60 "A" in the bottom half of the top half of the hand held nozzle where the grummet washer reference character 35 before the grummet washers are placed into the half round slots as they must be fitted near the front end of each top and bottom lever, then a stainless steel spring is placed behind the cut washer, the stainles steel spring is reference character 14 as the top spring and reference character 15 as the bottom spring with a line showing its placement just as the top spring, next a cut washer reference character 52 "A" is screwed and cut onto the front of the lever reference character 21, then a line stopper reference character 20 is placed on the front end of the lever, just as the bottom lever refrence character 16 that first has a grummet washer applied beginning the assembly of the top and bottom levers at the bend of the levers followed by a stainless steel spring reference character 15 then a cut washer that is also made of stainless steel reference character 52 is screwed and cut onto the levers followed by a line stopper reference character 17, and together with its parts the top and bottom levers are placed in their half round slots by their grummet washers that not only prevent leaks, but also holds the levers in postion while maintaining the position of the three attachments previously mentioned keeping them together and in place as shown on FIG. 9 with the see through x-ray view of the working parts showing the operation of the hand held nozzle as it is ready to receive water from the main water intake line reference character 27 as water then pass into the main water inlet canal reference character 19 and dispensed through the outlet can canal reference character 18 and then down into the outlet line reference character 26 the back of the hand held nozzle by squeezing the bottom lever of the hand held nozzle reference character 16, and when water is needed through the front head of the hand held nozzle the beautician squeezes the top lever of the hand held nozzle that will release water through the pinched canal reference character 12 deliverying water to and through the fron front spray head reference character 11, just as the bottom lever reference character 16 that sends water to the basin spray reference character 36 from the outlet line reference character 26 then from the outlet canal reference character 18 after the line stopper is removed reference character 17 by the bottom lever reference character 16 as the water is dispensed through the basin spray reference character 36 in the shampoo basin just below the neck cradle reference character 33, FIG. 7 a cut away half section of the shampoo basin that shows the connection of the basin spray to the inside of the front wall of the shampoo basin reference character 36 as the basin spray, then reference character 44 as the water ball then reference character 43 as the extractable stainless steel water supply line, then reference character 32 as the double threaded elbow and reference character 33 as the neck cradle, FIG. 6 is a inside view of the shampoo basins inner wall that shows the connection of the basin spray to the inside wall reference character 36 as the basin spray, reference character 44 as the water ball that connects the basin spray to the stainless steel extractable water supply line and reference character 33 as the neck cradle, FIG. 2 shows the assembly of the parts of the basin spray that receives water from outside the shampoo basin to the basin spray, reference character 7 as the double threaded nipple top threaded end is connected to the bottom of the double threaded elbow, as the top of the double threaded elbow reference character 32, as the double threaded elbow that is connected to the fully threaded water supply nipple reference character 6, that has the extractable stainless steel water supply line reference character 43 contained inside the fully threaded water supply nipple, reference character 39 as the flared end of the extractable stainles steel water supply line preventing the extractable stainless steel water supply line from being completly extracted through the assembled donut shaped washers as the first washer is reference character 38, then reference character 38 "A" as the second donut shaped washer and reference character 40 as the 1" one inch long third washer as all three washers are fully assembled on the extractable stainless steel water supply line shown at the bottom drawing on the FIG. 2 as the top drawing that shows the complete assembly of the stainless steel water supply line reference character 43 as it is contained inside the fully threaded water supply nipple connected to the basin spray reference character 36 as the extractable stainless steel water supply line inserted in the fully threaded water supply nipple with its three washers as the 1" one inch rest against the retainer cap reference character 37 then reference character 43 as the extractable stainless steel water supply line then reference character 41 that represents the stainless steel water supply line being extracted from the fully threaded water supply nipple coming through a hole in the retainer cap reference character 37 as that hole guides and supports the stainless steel water supply line. The retainer cap is shown in a three dimentional view on FIG. 2 reference character 37 as the retainer cap reference character 47 as that hole for the stainless steel water supply line reference character 43 as the fully threaded water supply nipple reference character 6 is connected to the double threaded elbow reference character 32 as the stainless steel water supply line inside the fully threaded water supply nipple is connected to the collar reference character 44 "A" of the water ball reference character 44 thats connected to the coupling reference character 45 "A", the lower drawings of the two three dimenstional drawing of the retainer caps reference character 37 on the right shows the female threaded inside reference character 42 that screws the retainer cap onto the front end of the fully threaded water supply nipple, reference character 37 as the retainer cap, on the top drawing of the assembled stainless steel water supply line reference character 43 as it extends out of the fully threaded water supply nipple reference character 6 as the threaded end of the stainless steel water supply line is connected to the female collar reference character 43 "A" as the threaded end and reference character 44 "A" as the collar of the water ball reference character 44 then reference character 48 as the water slot, then reference character 45 "A" as the coupling that snaps onto the water ball that allows water delivery but also allows the basin spray to move and to be swayable reference character 36, then reference character 36, then reference character 45 as the receiving sleeve that receives water from the water slot reference character 48 sending and dispersing water into the basin spray head by a disperser shown on FIG. 3 reference character 73. The delivery of water to the hand held nozzle that then sends water through the front spray head, or to the basin spray head in the shampoo basin, sending water to one device at a time or to both simultaneously is the two way spray system with an advantage over todays standar standard single spray hand held nozzle, and the standard shampoo basin. The two way spray system has a newly designed hand held nozzle that diverts water is the first invention that sends water in opposite directions, while the second invention is the basin spray that receives water from the bottom of the hand held nozzle to deliver water to the back and sides of the clients head as their head remains in one position without having to raise their head for rinsing after shampooing and saturating the back of the clients head before shampooing. The basin spray is also swayable and adjustable for each patron. The water temperature can be checked and adjusted by the beauticians as they can check the front spray head of the hand held nozzle and the basin spray at the same time by the same hand to check for a comfortable water temperature for the client preventing any kind of uncomfortable situatuion as a burn or to cold to the patrons head. And with this the beauticians can carry out a full saturation with proper temperture water for the patrons entire head more quickly as the beauticians can proceed to shampoo the entire head without having to stop for more water and to then rinse the entire head at the same time as the shampoo process is completed quickly in one continous action without the patron having to lift or move their head causing discomfort as the two way spray system will send water over the entire head while completly saturating the entire head with water before shampooing and while rinsing the entire head without having any excess water running down the patrons neck and back wetting their clothing, while causing discomfort that happens with todays traditional standard shampoo basins and the one way water delivery system that causes discomfort when the patron has to constantly lift and move their head doing the shampoo procedure in the conventional method when getting a hair shampoo. A problem that is eliminated when using the two way spray system. Because how it is made, allows for a better, quicker, and more comfortable shampooing and rinsing. This is shown on FIG. 8 with a open view of the two halfs of the two way nozzle spray reference character 50 as the bottom half and reference character 50 "A" as the top half as the top half, reference character 19 as the bottom halfs inlet canal, and reference character 19 "A" as the matching half of the inlet canal in the top half of the two way nozzle spray that will fit directly over the bottom half reference character 19 to form a perfect inlet canal just as reference character 18 of the bottom half of the two way spray nozzle as the bottom half of the outlet canal and reference character 18 "A" in the top half of the two way nozzle spray that will fit perfevtly over reference character 18 of the bottom half to form a perfect outlet canal. Then on both halfs of the two way nozzle spray reference character 50 and reference character 50 "A" then reference character 51 representing the same on both halfs of the two way nozzle spray as half round troughs that run in and around the inside and outside rim, where a round rubber gasket on FIG. 10 reference character 94 in a blow drawing that will fit into the half round troughs of the bottom half of the two way nozzle spray reference character 50 that will be fitted with the top half reference character 50 "A" empty troughs after the small rubber slice as shown on FIG. 10 reference character 95 is placed in the trough of the half round slot for the concave fitting on FIG. 8 reference character 74 of the male nipple reference character 72 as the concave fitting fits into the half round slot of the water inlet canals intake opening reference character 91 "A" of the bottom half of the two way nozzle spray and its matching half on the top half of the two way nozzle spray reference character 91 and also on the top half of the two way nozzle spray reference character 90 as the diverted water outlet half round opening that will match and fit the half round diverted water outlet opening after the small slice of rubber is placed in at reference characters 90, 91, 90 "A", and 91 "A" then the two male nipples as shown in a blow up front view reference character 72 and also a top view reference character 74 that also shows its concave connector, along with its rim reference character 23 as the concave connector is placed on the round rubber gasket at the opening, and along with the working parts of the two way nozzle sprays both halfs are then screwed together to form the two way spray system. Two better clarify the half round shape of the troughs and canals a bottom view of one half of the open two way nozzle sprays handle is shown on FIG. 8 reference character 55 a straight flat bottom view, then reference character 51 as one of four half round troughs shown shown, while there are a series of half round troughs through out both halfs of the two way nozzle spray, reference character 18 as one half of the outlet canal that supplys the basin spray and reference character 19 as the main water inlet canal that receives the main source of water.

The two way spray system can also be designed and operated with two seperate water delivery devices. It can be operated with the two way spray system that has two seperate levers with water delivery to the top and sides of the head as said invention that is the basin spray to deliver water to the back of the head. However a floor mounted shut off valve that releases water to the basin spray when stepping on its foot lever to open the shut off valve and raise the foot to shut off the water. This second method with the floor mounted shut off valve may cause the beauticians and their clients complications. Not unlike the said two way spray system with both operations of on and off levers held in one hand that is easy and comfortable for both the beautician and the client, as the control of deliverying water in opposite directions to the entire head, while ensuring a complete soaking and saturation of the head at once by two devices, with one at a time or at the same time that is, the two way spray system.

What is claimed is:

1. A two way spray system comprising:

a single hand held spray nozzle handle with dual action water delivery by top and bottom levers that sends water in opposite directions, with one direction to a front nozzle thats built into the front end of the single hand held spray nozzle handle, and water is sent to the front nozzle when the top lever is compressed while water is sent in a opposite direction when the bottom lever is compressed sending water to the basin spray built into the shampoo basin, as the single hand held spray nozzle handle can also send water in both directions simultaneously working as a diverter with both the top and bottom levers compressed;

a single hand held spray nozzle handle is made with two identical halfs, with each side or half made with half shell shaped canals, with half shell shaped gasket troughs lining around each half shell shaped canal, as all the half shell shaped canals and troughs will match up perfectly when the two halfs of the single hand held spray nozzle handle are put together, as a round rubber gasket is placed into the gasket troughs in order to form a water tight seal around each canal and handle when the two identical halfs are fastened with screws securing the two halfs and their canals forming complete whole canals that will receive and hold water in the single hand held spray nozzle handle;

a single hand held spray nozzle handle has four canals inside with one as the intake canal that receives water from the intake hose, as the intake canal distributes water to the pinch canal when the top lever is compressed, while sending water to the diverter canal that acts as a reservoir for the outlet canal until needed and released by the bottom lever, as all water flow is controled by two line stoppers, with one attached to the front of each lever, as one is attached to the top lever with the line stopper being located inside the body of the single hand held spray nozzle handle, where its inserted in the top opening of the intake canal, as the second line stopper is attached to the front end of the bottom lever as it is also located inside the body of the single hand held spray nozzle handle at the top of the outlet canals opening to the diverter canals opening, with the diverter canal feeding the outlet canal, as the line stopper sits between the two canals, and is operated by the bottom lever;

a single hand held spray nozzle handle that has two water hoses connected to its base by male nipple fittings, while the two hose fittings are female fittings, with one hose as the intake hose that brings water from a water source to the intake canal, while the second hose is a outlet hose that carrys water from the outlet canal to the basin spray;

a single hand held spray nozzle handle that delivers water to two different spray devices, with a front nozzle attached to the front of the single hand held spray nozzle handle, as it receives water from the pinch canal when the top lever is compressed, as the second spray device is the basin spray thats built into the front wall of the shampoo basin, aligned just under the neck rest of the shampoo basin, as the basin spray receives water from the diverter canal through the outlet canal and its outlet hose.

2. The two way spray system of claim 1 wherein the single hand held spray nozzle handles two spray devices that are different for the job they do, while the front nozzle is hand held for rinsing the top and sides of the head, the basin spray is built into the shampoo basin just under the neck cradle, and is adjustable and swayable to rinse the back of the head.

3. The two way spray system of claim 1 wherein the top and bottom levers connected to the hand held spray nozzle handle are each controled by a strong stainless steel spring seated just behind a line stopper thats fastened to the front end of each lever keeping adequate pressure on the line stopper in order to seal the opening of the canal until compression is applied to the spring loaded lever, as the spring gives resistance when the lever is being compressed thus allowing the spring to control the opening and closing of the canal when the lever is compressed and released controling the flow of water.

4. The two way spray system of claim 1 wherein the two way spray systems hand held spray nozzle handle has four water canals in its body, with the first being the intake canal that receives and stores water from the intake hose from a main water source, the intake canal has a small branch which is the second canal called the diverter canal, where water is held until allowed to be transfered to the outlet canal, which is the third canal, where water will come from the diverter canal when the bottom lever is compressed and the line stopper opens the opening between the diverter canal and the outlet canal allowing water to run through the outlet canal and down the outlet hose to the basin spray located inside the shampoo basin, and when the bottom lever is released the line stopper closes the outlet canal at the diverter canal where the water is stored until needed, and when the top lever is compressed it allows water to pass through the fourth canal, which is the pinch canal, thats pinched to partially close the canal in order to increase the water pressure as it exits the front nozzle spray, especially when both devices are used at the same time.

5. The two way spray system of claim 1 wherein the two way spray systems hand held spray nozzle handle with its two water hoses that are individually connected to the base of the hand held spray nozzle handle, as one is the intake water hose connected to the intake canal and the other water hose is connected to the outlet canal, the intake water hoses other end is connected to the main water source where the water is mixed with the hot and cold water until a proper temp is acheived for the clients comfort for shampooing and rinsing, while the second water hose connected to the base of the hand held spray nozzle handle is attached to the outlet canal that delivers water through the outlet hose to the basin spray to saturate the back of the clients head so they can remain in one position without moving their head as the sides and top of the head is being saturated at the same time with a comfortable water mix provided after the beautician has adusted the water mix by the front nozzle spray before compressing the bottom lever to send water to the basin spray.

6. The two way spray system of claim 1 wherein the hand held spray nozzle handles front spray nozzle is made of stainless steel in a round shaped disk with a series of spray holes arranged in a circular pattern in the front spray nozzles head, as its firmly seated in the front end of the hand held spray nozzle handle at the front opening of the pinch canal thats controled by the top lever that opens the intake canal releasing the line stopper allowing water to run through the pinch canal and out the front nozzle spray saturating the top and sides of the clients head as they remain in one position as the basin spray saturates the back of their head at the same time.

7. The two way spray system of claim 1 wherein the basin spray is made of two stainless steel half round plates with their rims bent in a "L" shape with concave snaps indented on each side so that when the top half is placed over the bottom they snap in place locking them together with the bottom half having a disperser hole cut in its center where its attached over a coupling that snaps onto a water ball with a water delivery hole cut into it as the water ball is attached to a threaded collar connected to a extractable stainless steel water supply line giving the basin spray adjustability as the water ball gives it swayability, as water exits the top half of the basin spray through a series of spray holes cut into the top half, with the basin spray located inside the front wall of the shampoo basin just below the neck rest connected to a fully threaded water supply nipple that extends through the front of the shampoo wall secured with nuts and washers as the fully threaded water supply nipple has the extractable stainless steel water supply line inside with the water ball connected to its front end where the basin spray is connected, as the fully threaded water supply nipple is connected outside the front wall of the shampo basin to the outlet water hose from the outlet canal to supply water to the adjustable and swayable basin spray as the client remains in the same comfortable position without the risk of having water run down their neck and back as the shape and location of the basin spray saturates the back of the clients head.

8. The two way spray system of claim 1 wherein the basin spray can saturate the back of the clients head, while together with the front nozzle spray saturating the top and sides as the entire at once is saturated completly in preparation before a shampoo as a pre-rinse before any soap or shampoo is applyed, and then for the final rinse after the scrubbing of the head and scalp is completed doing the shampoo process, as the job is made quicker when all the beautician has to do is apply the soap or shampoo as the clients head remains in the same position doing the entire operation as the beautician rinses the back of the clients head at the same time she rinses the top and sides as she compress both the top and bottom levers of the hand held nozzle spray handle together saturating the head, making for a more quicker, thorough, and comfortable experience for the client without having to lift their head doing the operation allowing water to run down their neck and back wetting their clothing as the shampoo process is very convenient for both the client and the beautician.

9. The two way spray system of claim 1 wherein the two way hand held spray nozzle handles four canals work in unison when both the top and bottom levers are compressed simultaneously especially with the pinching of the pinch canal as its purpose is increase the water pressure as it exits the front nozzle when the top lever is compressed, as it helps to maintain a steady water pressure to the basin spray with the bottom lever being compressed along with the top lever without having any device having interrupted water pressure as the beatician saturates the entire head of the client at the same time with all four canals working together as the diverter canal feeds the outlet canal and the intake feeds both the diverter and the pinch canal as the two way spray system and its adjustable basin spray and all the other compnents creating a very efficient, comfortable, and convenient shampoo experience for the client as well as for the beautician.

* * * * *